US006716317B2

(12) United States Patent
Gafner et al.

(10) Patent No.: US 6,716,317 B2
(45) Date of Patent: Apr. 6, 2004

(54) TENSION DECURLER FOR WEB MATERIAL

(75) Inventors: Jeffrey U. Gafner, Cambridge, WI (US); Robert L. Turnquist, Waunakee, WI (US)

(73) Assignee: Marquip, LLC, Phillips, WI (US)

( * ) Notice: Subject to any disclaimer, the term of this patent is extended or adjusted under 35 U.S.C. 154(b) by 0 days.

(21) Appl. No.: 10/056,376

(22) Filed: Jan. 24, 2002

(65) Prior Publication Data

US 2003/0145967 A1 Aug. 7, 2003

(51) Int. Cl.[7] ..... D21F 1/00; D21H 1/00; D21J 1/00

(52) U.S. Cl. ..... 162/271; 162/270; 162/197; 271/188; 493/459; 493/460; 493/461

(58) Field of Search ..... 162/270, 271, 162/197; 271/188; 493/459, 460, 461

(56) References Cited

U.S. PATENT DOCUMENTS 3,661,703 A * 5/1972 Shelor ..... 162/271
6,279,472 B1 * 8/2001 Kishine et al. ..... 101/228

* cited by examiner

*Primary Examiner*—Steven F. Griffin
*Assistant Examiner*—Mark Halpern
(74) *Attorney, Agent, or Firm*—Andrus, Sceales, Starke & Sawall

(57) ABSTRACT

A running web is decurled by controlling web tension as well as the angle of wrap on a decurler roll and a cooperating pivot roll, all without affecting web tension in the downstream web converting process. An upstream brake roll and a downstream pull roll control web tension within the decurler apparatus and independent decurler rolls are provided for removing up-curl and down-curl.

18 Claims, 5 Drawing Sheets

TENSION DECURLER FOR WEB MATERIAL

BACKGROUND OF THE INVENTION

The present invention relates to an apparatus and method for removing the curl from a running web of material being delivered from a storage roll. More particularly, the apparatus and method of the present invention are particularly suitable for decurling a paper or paperboard web, but is also applicable to webs of plastics and other materials.

It is well known in the art that web material which has been wound tightly on a roll takes a set such that the web or sheets cut from the web exhibit a curl which is manifested by a concave face on the inside face of the web with respect to its orientation on the roll. Furthermore, the curl becomes more pronounced nearer the center of the roll. Because the curl in a web or in sheets cut from the web generally interferes with and is detrimental to downstream conversion processes, much attention has been devoted in the industry to methods and apparatus for removing curl. Such efforts have focused primarily on removing the curl immediately downstream from the supply roll and before the web enters the conversion process.

Most decurling apparatus operates by causing the web to be back wrapped around a decurler bar or decurler roll in the opposite direction from which the web was wound on the supply roll. Typically, the decurler bar or decurler roll has a relatively small diameter so that a small radius back wrap is imparted to the running web to remove the curl. In one common type of decurler, the running web traveling between a pair of transfer rolls with the inside face of the web in contact with the rolls is contacted on its opposite face with a small diameter decurler roll that deflects the web out of its path of travel and causes it to partially wrap around the circumference of the decurler roll. It is also known to place the decurler roll in close proximity to one of the transfer rolls but, because the back wrap or back bending of the web around the smaller diameter decurler roll is much more severe, the set caused by the original curl may be reversed and the web flattened.

However, back bending a web around a small diameter roll often results in damage to the surface of the sheet. This damage, commonly referred to as checking or cracking, appears as permanent wrinkles or creases throughout the surface of the web on the face that contacts the small diameter roll. Checking or cracking is the result of compressive failure of the web face and can adversely affect the surface of a paper web, the coating on a web, and/or the bond between the coating and the paper. Other web materials may be similarly adversely affected.

SUMMARY OF THE INVENTION

The subject invention arose out of an investigation into the causes of cracking and checking induced by back bending or back wrapping the web around a decurler roll. It has been discovered that tensioning the web prior to decurling eliminates checking and cracking. It is believed that, by raising the overall web tension prior to back wrapping the web around the small diameter decurler roll, the inside face of the web in contact with the decurler roll can absorb the compressive forces of bending without failure resulting in checking. Simultaneously, the outside of the pretensioned web is stretched further due to the tensile forces of bending. The stretching of the outside web face results in a yielding of the paper fibers which removes the curl or set. It is believed that the yielding of the outside face moves the neutral surface of the sheet back toward the center of the web, removing residual stresses and creating a flat sheet.

Another important aspect of the method and apparatus of the present invention is to create the increased tension in the web for decurling without affecting web tension upstream from the web supply roll and downstream in the converting process operating at a desired line tension. If desired, however, the apparatus of the present invention may be operated to purposely change or adjust line tension downstream of the decurling apparatus. In other words, a line tension may be provided that is higher or lower than tension of the incoming web from the web supply.

In accordance with the method of the present invention, a running web delivered from a supply roll to a downstream conversion process operating at line web tension is decurled with a method comprising the steps of (1) creating a zone of increased web tension greater than line tension downstream of the supply roll and upstream of the process, (2) positioning a rotatable decurler roll in contact with one face of the web in the zone of increased web tension, and (3) adjustably positioning the decurler roll to selectively deflect the web from a normal path of travel through the zone and to vary the amount of circumferential wrap of the web on the decurler roll. In accordance with the preferred method, the zone of increased tension is created by (1) passing the web around a brake roll at an upstream end of the zone, and (2) passing the web around a pull roll at a downstream end of the zone.

In accordance with the preferred embodiment, the method also includes the steps of (1) positioning a rotatable pivot roll in contact with the opposite face of the web immediately adjacent the decurler roll, and (2) adjusting the position of the decurler roll to simultaneously vary the amount of circumferential wrap of the web on the decurler roll and the pivot roll. The adjusting step preferably comprises moving the decurler roll in an orbital path around the circumference of the pivot roll.

The method also preferably includes the steps of (1) passing the web around an infeed idler roll upstream of the brake roll, and (2) passing the web around an outfeed idler roll downstream of the pull roll. The method also preferably includes the steps of (1) providing separate drives for the brake roll and the pull roll, and (2) adjusting the drives to selectively vary web tension in the zone.

The preferred apparatus of the present invention comprises an upstream brake roll that receives and rotatably engages the web delivered from the supply roll, a downstream pull roll that receives and rotatably engages the web received from the brake roll, the brake roll and pull roll operative to create in the web therebetween a zone of web tension greater than line web tension, a decurler roll positioned in the web tension zone rotatably engaging the outer face of the web with respect to web orientation on the supply roll, and a decurler roll adjustment mechanism that is operative to adjustably position the decurler roll to deflect the web from a normal path of travel through the web tension zone and to vary the angle of circumferential wrap of the web on the decurler roll. Preferably, the apparatus also includes a rotatable pivot roll mounted in counterrotating relation with the decurler roll to carry the web in the tension zone in engagement with the inner face of the web. In the preferred embodiment, the pivot roll has a diameter substantially greater than the diameter of the decurler roll and is mounted directly adjacent the decurler roll.

In accordance with the preferred embodiment of the apparatus of the present invention, the decurler roll adjustment mechanism operates to move the decurler roll around the circumference of the pivot roll to simultaneously vary the angle of circumferential wrap of the web on the pivot roll and the decurler roll. More particularly, the adjustment mechanism comprises a pair of mounting brackets, each attached at a radial inner end to a pivot shaft rotatably supporting the pivot roll and at a radial outer end to a journaled connection to one axial end of the decurler roll, and a drive operatively connected to the pivot shaft to rotate the shaft and mounting brackets and to carry the decurler roll in an orbital path around the circumference of the pivot roll.

The decurler apparatus also preferably includes an infeed idler roll mounted upstream of the brake roll and an outfeed idler roll mounted downstream of the pull roll. The apparatus may also include an intermediate idler roll carrying the web to the pull roll. In order to handle web materials which may be delivered with either an up curl or a down curl, the apparatus preferably includes a second decurler roll and a second pivot roll positioned downstream of the main decurler roll and pivot roll and upstream of the intermediate idler roll, the second decurler roll and second pivot roll oriented to operate on a web delivered from a second supply roll with its outer face inverted from the web delivered from the main supply roll.

The brake roll includes a brake roll drive that is operative to retard web movement and the pull roll includes a separate pull roll drive that is operative to increase web movement. The brake roll drive and the pull roll drive are independently adjustable to selectively vary web tension in the web tension zone.

DETAILED DESCRIPTION OF THE PREFERRED EMBODIMENT

Figure 1:
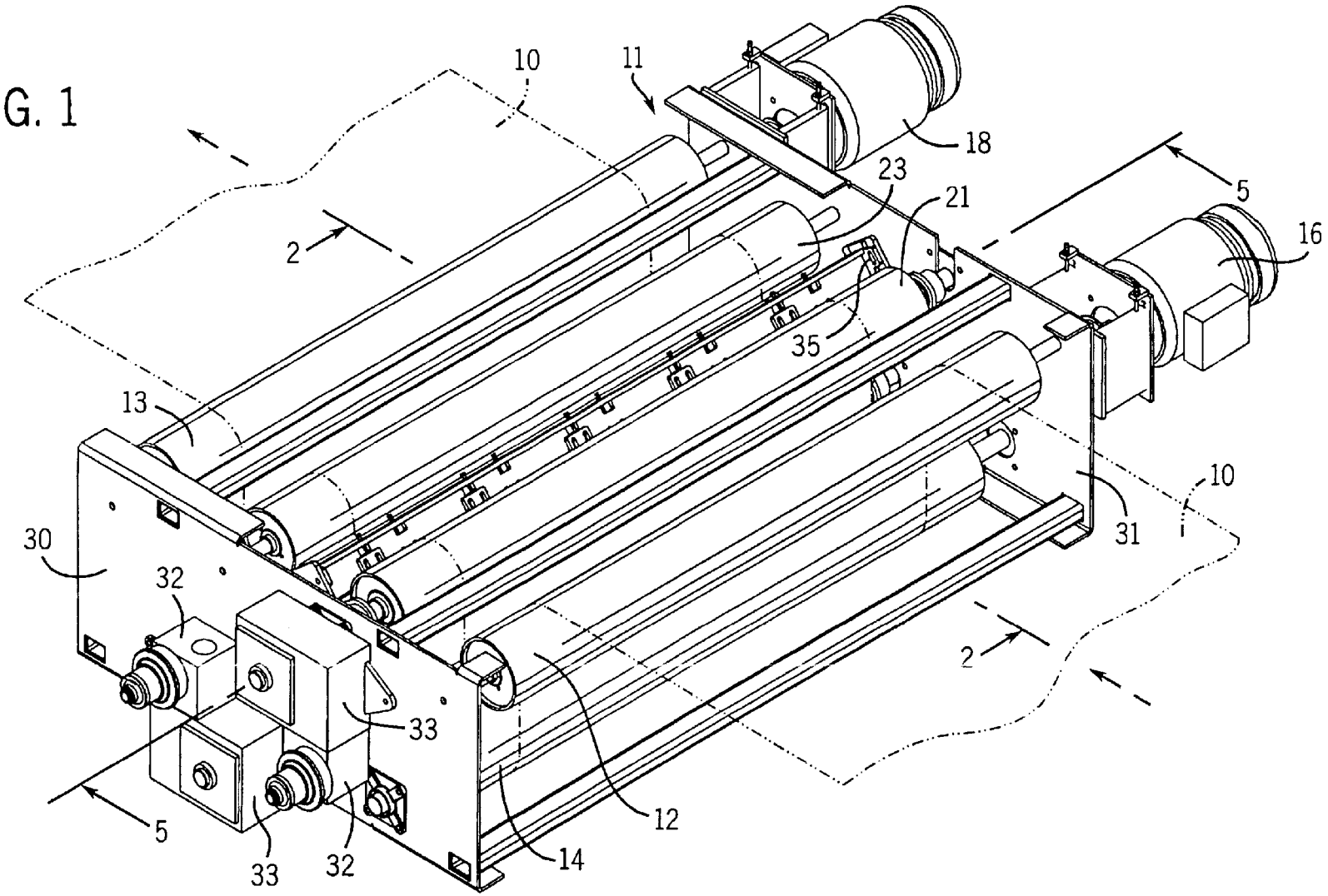
FIG. 1 is an isometric view of the presently preferred embodiment of the present invention with the web shown in phantom.

In FIG. 1, a web 10 of a material, such as paper, is fed from an upstream source, such as a roll mounted on a roll stand (not shown) into a decurler apparatus 11 of the present invention. After decurling, the web 10 leaves the decurler 11 and continues downstream for conversion. For example, a paper or paperboard web 10 may be converted downstream into sheets by processing the web through longitudinal slitting and lateral cutting devices, all in a manner well known in the art. As is also well known in the art, in a typical sheeter line, the paperboard web is supplied from either of two rolls from which the web first passes through a splicer where the tail end of the web on the expiring roll is connected to the lead end of the web on the new roll so that operation of the line is uninterrupted. However, because the outside face of the web on either roll may be facing up or down as the web enters the converting process, the web may exhibit either an up-curl or a down-curl. The decurler 11 is preferably constructed to handle both web orientations.

Figure 2:
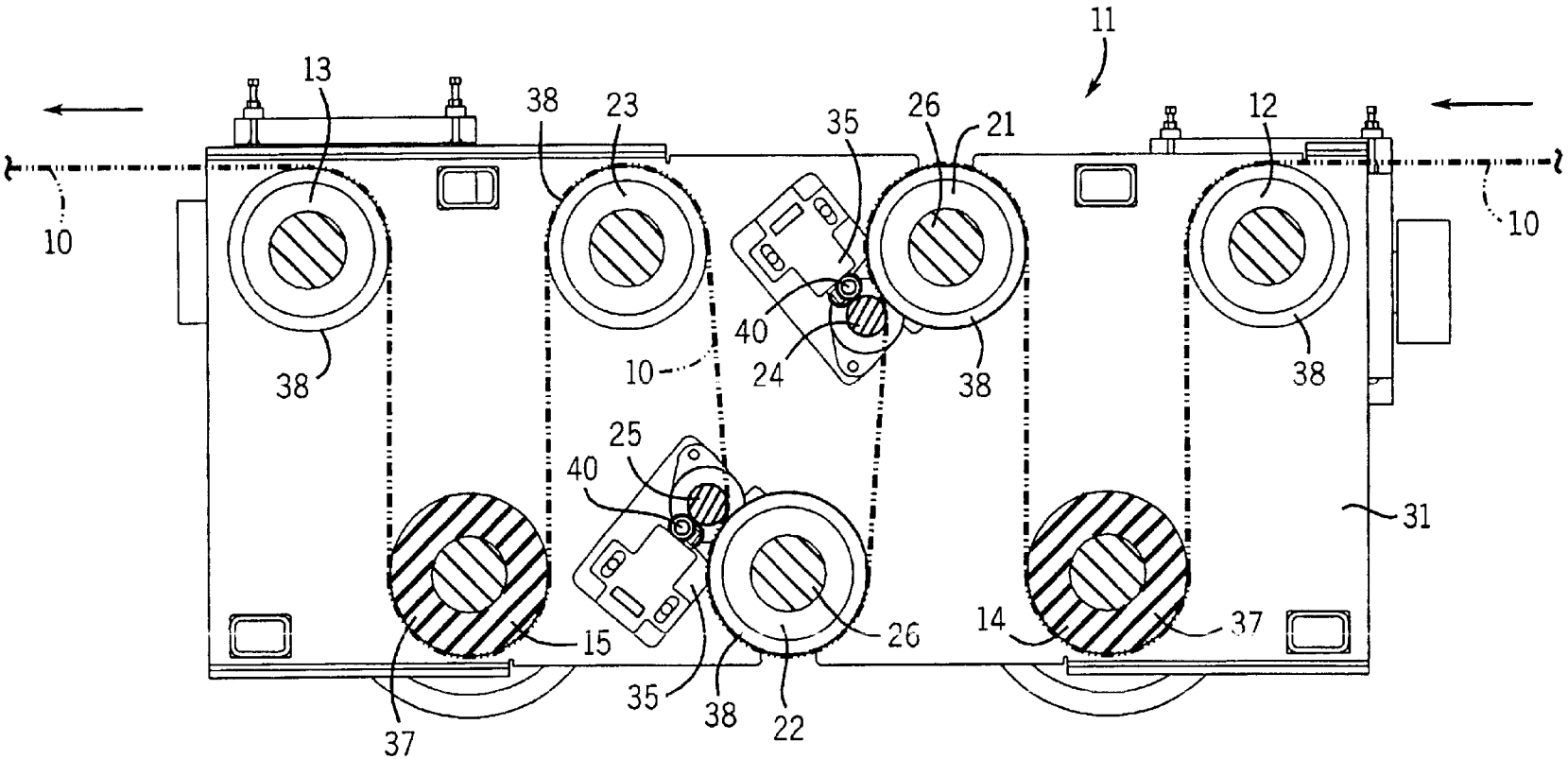
FIG. 2 is a vertical section taken on line 2—2 of FIG. 1 showing the path of the web through the apparatus in the idle or thread up position.
Figure 6:
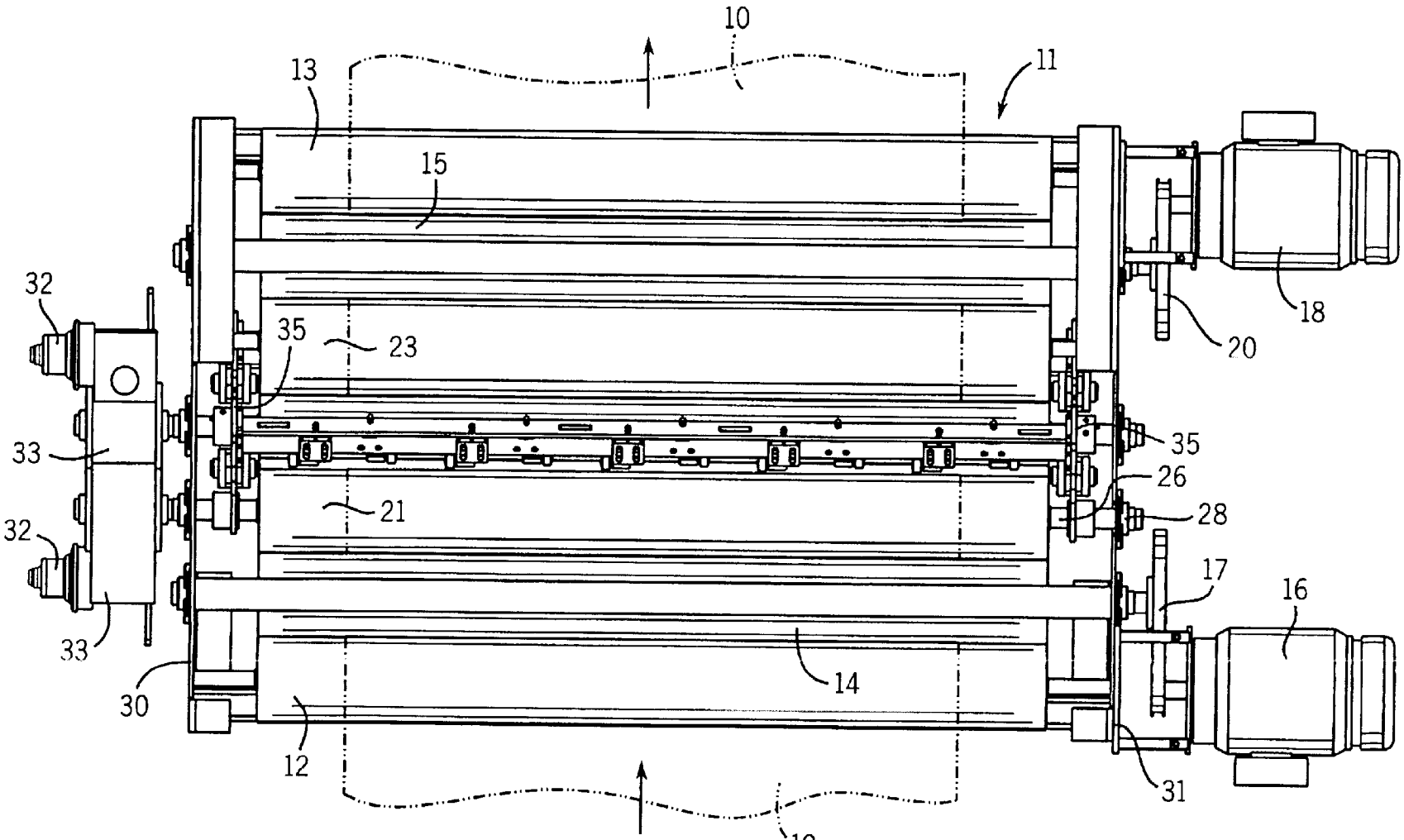
FIG. 6 is a top plan view of the apparatus shown in FIG. 1.

Referring also to FIGS. 2 and 6, the web 10 from the roll stand and splicer enters the decurler 11, typically in a horizontal orientation, where it is initially wrapped approximately ninety degrees around an infeed idler roll 12. Similarly, the web 10, after decurling, exits the decurler at the downstream end of the decurler by passage around an outfeed idler roll 13. In between, the web traverses a serpentine path through the decurler (FIG. 2) around a series of rolls as will be described hereinafter.

Immediately downstream of the infeed idler roll 12 and immediately upstream of the outfeed idler roll 13, the web passes around, respectively, a brake roll 14 and a pull roll 15. As best seen in FIGS. 1 and 6, the brake roll 14 is driven by a brake roll drive motor via a drive connection 17 which may conveniently comprise a conventional timing belt and pulley arrangement. Similarly, the pull roll 15 is driven by a pull roll drive motor 18 via a drive connection 20.

The brake roll 14 is driven to slightly retard web movement with respect to incoming web velocity. Conversely, the pull roll is driven at a slight overspeed with respect to line web speed. The result is that web travelling between the brake roll 14 and the pull roll 15 is subjected to an increased tension. However, web tension into the decurler 11 and line web tension in the web 10 downstream of the decurler remain unaffected. The result is the creation of a zone of increased tension in the web between the brake roll 14 and pull roll 15. As will be explained hereinafter, decurling the web in the zone of increased tension, combined with other features of the decurler 11, results in effective decurling without checking or cracking of the web surface. Again, as best seen in FIG. 2, mounted serially in the tension zone beginning downstream from the brake roll 14 are an upper pivot roll 21, a lower pivot roll 22 and an intermediate idler roll 23. These rolls when combined with the infeed and outfeed idler rolls 12 and 13, the brake roll 14 and the pull roll 15 create a six run serpentine path through the decurler 11. The intermediate four runs of the serpentine path, between the brake roll 14 and the pull roll 15, comprise the zone of increased tension. The infeed and outfeed idler rolls 12 and 13 are positioned to provide a full 180 degrees of web wrap around respective brake roll 14 and pull roll 15.

Figure 3:
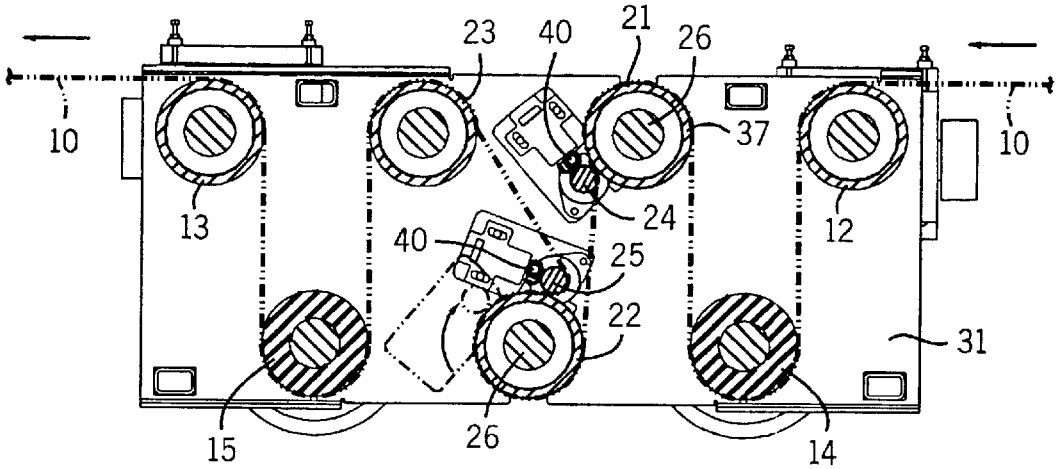
FIG. 3 is a view similar to FIG. 2, but showing one of the decurler rolls rotated to an operative position for removing an up curl from the web.
Figure 4:
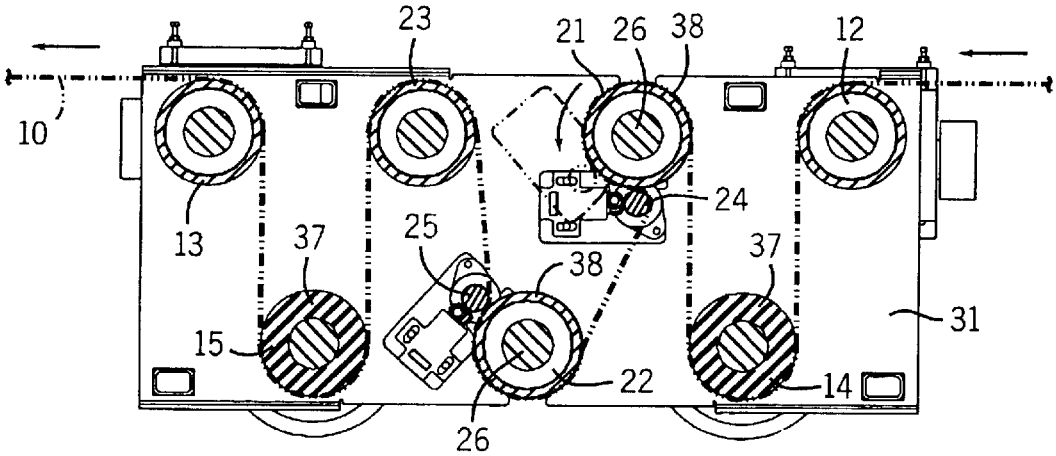
FIG. 4 is a view similar to FIG. 3, but showing the other decurler roll rotated to an operative position to remove a down curl from the incoming web.
Figure 5:
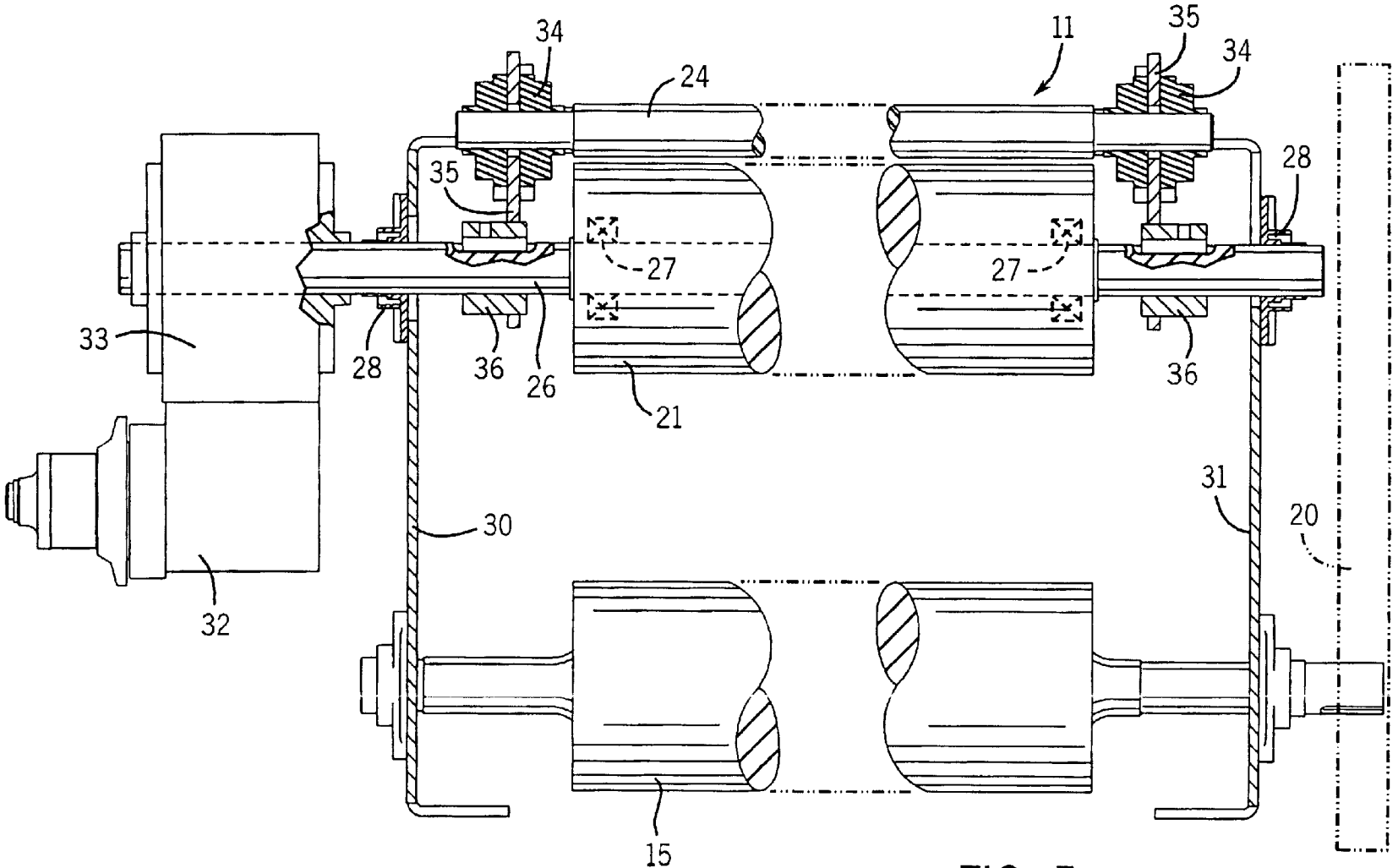
FIG. 5 is an enlarged vertical section taken on line 5—5 of FIG. 1, but showing the decurler roll rotated to an upper inoperative position for clarity.

Referring also to FIGS. 3–5, an adjustable position upper decurler roll 24 is mounted in association with the upper pivot roll 21 and, in a similar manner, a lower decurler roll 25 is adjustably mounted to operate with the lower pivot roll 22. The mounting and operation of the upper and lower decurler rolls 24 and 25 is identical, and one or the other is utilized to decurl the web 10 depending on the direction of the curl. Thus, if the decurler of the present invention were utilized in a converting process in which the web was always oriented the same, only a single combination of pivot roll and decurler roll would be necessary. As indicated above, however, in some conversion processes, webs may be alternately fed from one of a pair of roll stands, each of which orients the web opposite the other, thereby requiring a decurler having a pair of decurling mechanisms as described herein. Furthermore, in the case of web supply from a single roll stand, the roll can be loaded on and fed from the roll stand to unwind in either direction. In this case, a decurler handling both directions of curl would be required.

If the incoming web 10 is delivered from a roll in which the outer web face is on top (thus presenting a web with a so called down-curl), then the upper pair of pivot roll 21 and decurler roll 24 are utilized to remove the curl. As best seen in FIG. 5, the upper pivot roll 21 is pivotally mounted on a pivot roll shaft 26 by a pair of inboard pivot roll bearings 27. The outer ends of the pivot roll shaft 26 are also rotatably supported in journal bearings 28 mounted on the opposite front and rear frame members 30 and 31, respectively. The pivot roll shaft 26 is driven by an air motor 32 via a reducer 33 mounted adjacent the front frame member 30. Various other types of motors could be used for the drive as well. Operation of the air motor 32 will thus rotate the pivot roll shaft 26, but the pivot roll 21 remains independently rotatable as an idler roll via the pivot roll bearings 27.

The upper decurler roll 24 is rotatably journaled by its opposite ends in a pair of sleeve bearings 34. The bearings 34 are each fixed to one end of a mounting bracket 35 and the opposite end of each mounting bracket is fixed to a bushing 36 that is keyed to the pivot roll shaft 26 to rotate therewith. The diameter of the decurler roll 24 is substantially smaller than the diameter of the pivot roll 21. For example, the decurler rolls 24 and 25 may have diameters of about two inches (about 50 mm) and the pivot rolls 21 and 22 may have diameters of about eight inches (about 200 mm). The mounting brackets 35 hold the decurler roll 24 closely spaced from the surface of the pivot roll 21, the spacing between the roll surfaces being, for example, about 0.25 inch (about 6 mm). Operation of the air motor 32 rotates the pivot roll shaft 26 causing the decurler roll 24 to move in an orbital path around the pivot roll. Referring to FIG. 4, as the upper decurler roll 24 is rotated in a counterclockwise direction as shown by the arrow, the decurler roll 24 will deflect the web 10 laterally out of its generally vertical path of travel as it leaves the pivot roll, cause the angle of wrap of the web on the upper pivot roll 21 to be increased, and to simultaneously cause the web to wrap around the decurler roll 24 itself. The basic movement of a decurler roll (or sometimes a non-rotating decurler bar) into engagement with one face of the web to deflect it out of its path of travel is a common feature of many prior art decurler devices. However, this basic movement of the decurler roll 24 is supplemented by other features of the present invention to enhance the decurling operation and prevent checking or cracking of the web face contacted by the decurler roll 24.

Because of the relatively small diameters of the decurler rolls 24 and 25 and as is well known in the art, each mounting bracket 35 carries a series of axially spaced and aligned backup rollers 40 that ride against and support the decurler roll against deflection resulting from the web tension loads imposed on the rolls. The backup rollers 40 may comprise conventional cam follower rollers or any other suitable small journaled rollers.

It is believed that checking or other surface damage in a web being decurled results from compressive forces caused by back bending the web around the small diameter decurler bar or roll. To eliminate such compressive force damage, the web is pretensioned by increasing the overall web tension before the web is back wrapped around the small diameter decurler roll 24 or 25. This permits the inside of the web back wrapped on the small diameter decurler roll to absorb the compressive forces before surface failure. The outside of the web (opposite the decurler roll), is stretched as a result of the tensile forces of bending. This stretching is believed to cause the outside surface to yield thereby removing the set which is manifested by the curl by moving the neutral surface of the web back toward the centroidal surface thereby removing residual stresses and creating a flat sheet. Thus, the method and apparatus of the present invention utilize several techniques to enhance decurling and minimize the likelihood of sheet damage. First, the tension zone is created to pretension the web, as indicated above. The angle of wrap of the web on the pivot roll 21 by orbital movement of the decurler roll 24 increases the surface contact between the web and the roll. This is believed to help prevent relative motion between the web and the roll surface thereby optimizing the stretching of the outer surface with respect to the inner surface (back wrapped around the decurler roll 24 or 25). It is also believed to be important to locate the decurler roll 24 or 25 as close as possible to its respective pivot roll 21 or 22. The pre-stretched condition of the web surface resulting from wrapping the web on the pivot roll is not immediately lost by the web relaxing. Rather, the hysteresis effect of tension in the web allows the stretched surface of the web to come into contact with the decurler roll more quickly and while the web is still stretched. In addition, orbital movement of the decurler roll to deflect the web out of its normal path and wrap the web around the pivot roll, also results in an increased back wrap of the web on the decurler roll. This increased circumferential contact also helps prevent relative motion between the roll and the web surface, which motion might otherwise allow the inside surface of the web to fail in compression and buckle or crack.

In order to assure the maintenance of uniform web tension in the tension zone between the brake roll 14 and the pull roll 15, these rolls are preferably provided with an outer layer of a relatively soft, high coefficient of friction material, such as a urethane rubber. Although it is also important that the web 10 not slip on the other rolls in the tension zone, i.e. the upper and lower pivot rolls 21 and 22, these rolls preferably have an outer steel shell 38, although other higher coefficient of friction surfaces may also be utilized. The decurler rolls 24 and 25 are also preferably made of steel. The various idler rolls 12, 13 and 23 may be of a construction similar to the pivot rolls 21 and 22.

The decurler 11 of the present invention may be utilized to decurl webs of a fairly wide range of web calipers (thickness), ranging at least from about 0.008 inch (0.2 mm) to about 0.030 inch (about 0.8 mm). The current limitation on decurling a paperboard web having a caliper greater than about 0.030 inch is that heavier webs are not commonly provided on rolls for use in a conventional sheeter or other converting system. However, it is believed that paperboard webs having a caliper of 0.044 inch (about 1 mm) or heavier could be successfully decurled with the apparatus and method of the present invention if such web stock were available in rolls.

Control of decurling in the apparatus of the present invention is accomplished by adjustment of two variables. By retarding the motor 32 for the brake roll 14 and/or increasing the torque on the motor 32 driving the pull roll 15, tension on the web 10 in the tension zone between those rolls may be varied over a wide range. It is believed that an increase in tension up to about ten pounds per lineal inch of web width is suitable for handling webs in the range identified above. In addition to tension control, adjustment of the orbital position of the decurler roll 24 or 25 around its respective pivot roll 21 or 22 also has a significant effect on the decurling process. The position of the decurler roll (and thus the amount of web wrap around the decurler roll and its companion pivot roll) is varied based on web material and also based on the inherent increase in web curl as the web proceeds closer to the roll core from which it is unwound. Automatic control of the brake roll and pull roll drive motors 16 and 18 and the decurler roll air motors 32 may thus be used to control decurling as the web is delivered to the decurler.

As indicated above, tension on the web 10 in the tension zone may be varied by independently controlling the retarding torque applied to the brake roll, independently controlling the overdrive torque applied to the pull roll 15, or by simultaneously controlling both. With this flexibility in controlling tension in the tension zone, it is also possible to adjust the output web tension so that line web tension is higher or lower than the tension in the web entering the decurler. It should also be noted that other rolls in the decurler apparatus, such as the decurler rolls and the pivot rolls will also add drag and therefore add tension to the zone of increased tension within the decurling apparatus.

Although it is preferred to operate the brake roll 14 and pull roll 15 using the respective drive motors 16 and 18, the brake roll may be retarded by other means, such as a pneumatic braking system. Other means of imposing a variable drag on the brake roll could also be used. However, by using a drive motor 16 to retard the brake roll 14, the brake roll acts as a generator and the electrical energy so generated can be fed back into the pull roll motor 18 via the motor drive. In this manner, energy is not lost as heat, as would occur in using other means to brake the roll.

We claim:

1. An apparatus for decurling a running web delivered from a supply roll and led to a downstream conversion process operating at a line web tension, said apparatus comprising an upstream brake roll receiving and rotatably engaging the web from the supply roll;

a downstream pull roll receiving and rotatably engaging the web from the brake roll;

said brake roll and said pull roll operative to create in the web therebetween a zone of tension greater than the line web tension;

a decurler roll in the web tension zone rotatably engaging the outer face of the web with respect to web orientation on the supply roll; and, a decurler roll adjustment mechanism operative to adjustably position the decurler roll to deflect the web front a normal path or web travel through the web tension zone and to vary the angle of circumferential wrap of the web on the decurler roll.

2. The apparatus as set forth in claim 1 including a rotatable pivot roll mounted in counterrotating relation with the decurler roll to carry the web in the tension zone in engagement with the inner face of the web.

3. The apparatus as set forth in claim 2 wherein the pivot roll has a diameter substantially greater than the diameter of the decurler roll, said pivot roll mounted directly adjacent said decurler roll.

4. The apparatus as set forth in claim 3 wherein the decurler roll adjustment mechanism is operative to move the decurler roll around the circumference of the pivot roll to simultaneously vary the angle of circumferential wrap of the web on the pivot roll and the decurler roll.

5. The apparatus as set forth in claim 4 wherein the adjustment mechanism comprises:

a pair of mounting brackets, each attached at a radial inner end to a pivot shaft rotatably supporting the pivot roll and at a radial outer end to a journaled connection to one axial end of the decurler roll; and, a drive operatively connected to said pivot shaft to rotate the pivot shaft and mounting brackets and to carry the decurler roll in an orbital path around the circumference of the pivot roll.

6. The apparatus as set forth in claim 2 including an infeed idler roll upstream of the brake roll and an outfeed idler roll downstream of the pull roll.

7. The apparatus as set forth in claim 1 including a brake roll drive operative to retard web movement and a pull roll drive operative to increase web movement.

8. The apparatus as set forth in claim 7 wherein said brake roll drive and pull roll drive are adjustable to selectively vary web tension in the web tension zone.

9. An apparatus for decurling a running web being delivered from a supply roll and fed to a downstream conversion process operating at a line web tension, said apparatus comprising:

an upstream brake roll receiving and rotatably engaging the web from time supply roll;

a downstream pull roll receiving and rotatably engaging the web from the brake roll;

said brake roll and said pull roll operative to create in the web therebetween a zone of web tension greater than the line web tension;

a pivot roll in the web tension zone rotatably engaging the inner face of the web with respect to web orientation on the supply roll;

a decurler roll rotatably engaging the outer face of the web with respect to web orientation on the supply roll; and, an adjustment mechanism operative to move the decurler roll orbitally around the circumference of the pivot roll and to provide a desired amount of circumferential wrap of the web on both the decurler roll and the pivot roll.

10. The apparatus as set forth in claim 9 wherein the decurler roll is substantially smaller in diameter than the pivot roll.

11. The apparatus as set forth in claim 10 wherein the ratio of the diameters of the decurler roll and the pivot roll is about 1:4.

12. The apparatus as set forth in claim 8 including an in feed idler roil for the web upstream of the brake roll and an outfeed idler roll for the web downstream of the pull roll, and wherein said infeed roll, brake roll, pivot roll, pull roll and outfeed roll are mounted to define a serpentine path of web travel through the apparatus.

13. The apparatus as set forth in claim 9 including a drive motor for each of said brake roll and pull roll, said pull roll motor operative to drive the pull roll at an overspeed with respect to web speed and said brake roll motor operative to retard the brake roll with respect to web speed.

14. The apparatus as set forth in claim 9 including a pull roll motor operative to drive the pull roll at a variable overspeed with respect to web speed, and means for applying a variable retarding load to the pull roll.

15. An apparatus for decurling a running web delivered from a supply roll at an input web tension and fed to a downstream conversion process operating at a line web tension, said apparatus comprising:

upstream braking means for receiving and applying a web retarding load to the web from the supply roll;

downstream pulling means for receiving and applying a web overdrive force to the web from the braking means;

said pulling means and said braking means operative to create in the web therebetween a zone of increased tension greater than the input web tension and the line web tension;

decurling means in the web tension zone for engaging the outer face of the web with respect to web orientation on the supply roll and deflecting the web from a linear path of travel; and means for controlling said braking means and said pulling means to vary web tension in said tension zone.

16. The apparatus as set forth in claim 15 wherein said controlling means is operable to provide an output line web tension different from the input web tension.

17. An apparatus for decurling a running web delivered from a supply roll and fed to a downstream conversion process operating at a line web tension, said apparatus comprising an upstream brake roil receiving and rotatably engaging the web from the supply roll;

a downstream pull roll receiving and rotatably engaging the web from the brake roll;

said brake roll and said pull roll operative to create in the web therebetween a zone of tension greater than the line web tension;

a decurler roll in the web tension tone rotatably engaging the outer face of the web with respect to web orientation on the supply roll;

a decurler roll adjustment mechanism operative to adjustably position the decurler roll to deflect the web from a normal path of web travel through the web tension zone and to vary the angle of circumferential wrap of the web on the decurler roll;

a rotatable pivot roll mounted in counterrotating relation with the decurler roll to curry the web in the tension zone in engagement with the inner face of the web;

an infeed idler roll upstream of the brake roll and an outfeed idler roll downstream of the pull roll; and an intermediate idler roll carrying the web to the pull roll.

18. The apparatus as set forth in claim 17 including a second decurler roll and a second pivot roll positioned downstream of the decurler roll and pivot roll and upstream of the intermediate idler roll, said second decurler roll and second pivot roll oriented to operate on a web delivered from a second supply roll with its outer face inverted from the web delivered from said supply roll.

* * * * *